US009039332B2

(12) United States Patent
Moon et al.

(10) Patent No.: US 9,039,332 B2
(45) Date of Patent: May 26, 2015

(54) FACILITIES FOR OFFSHORE LIQUEFIED NATURAL GAS FLOATING STORAGE WITH JACK-UP PLATFORM REGASIFICATION UNIT

(75) Inventors: Ki Ho Moon, Uijeongbu-si (KR); Kwang Ho Wi, Seoul (KR); Seong Min Yang, Busan (KR); Ho Joon Shin, Seongnam-si (KR); Su Hyuk An, Seoul (KR); Kil Hong Kim, Seongnam-si (KR); Heon Joong Jung, Seongnam-si (KR); Jae Hyuk Jang, Seoul (KR); Chul Jin Moon, Seoul (KR); Jae Heon Lee, Seoul (KR); Hyun Sang Cho, Seoul (KR); Sung Uk Lee, Seoul (KR)

(73) Assignee: Samsung C&T Corporation, Seoul (KR)

( * ) Notice: Subject to any disclaimer, the term of this patent is extended or adjusted under 35 U.S.C. 154(b) by 0 days.

(21) Appl. No.: 13/977,175

(22) PCT Filed: Dec. 19, 2011

(86) PCT No.: PCT/KR2011/009771

§ 371 (c)(1),
(2), (4) Date: Sep. 6, 2013

(87) PCT Pub. No.: WO2012/091336

PCT Pub. Date: Jul. 5, 2012

(65) Prior Publication Data

US 2013/0333397 A1 Dec. 19, 2013

(30) Foreign Application Priority Data

Dec. 30, 2010 (KR) ..... 10-2010-0139361

(51) Int. Cl.
*E02B 17/02* (2006.01)
*F17C 7/04* (2006.01)
*E02B 17/00* (2006.01)

(52) U.S. Cl.
CPC . *F17C 7/04* (2013.01); *E02B 17/00* (2013.01); *E02B 2017/0073* (2013.01);

(Continued)

(58) Field of Classification Search
CPC ..... E02B 17/021; E02B 17/04; E02B 17/08
USPC ..... 405/196, 197, 198, 199, 200, 210
See application file for complete search history.

(56) References Cited

U.S. PATENT DOCUMENTS
3,984,059 A * 10/1976 Davies ..... 405/210
4,232,983 A * 11/1980 Cook et al. ..... 405/210

(Continued)

FOREIGN PATENT DOCUMENTS
CN 101057101 A 10/2007
CN 201132954 Y 10/2008

(Continued)

OTHER PUBLICATIONS
Japanese Office Action dated Jun. 10, 2014 corresponding to Japanese Patent Application No. 2013-547306 and U.S. Appl. No. 13/977,175; along with the English translation.
Office action from Chinese Patent Office for corresponding Chinese Application No. 201180063786.6 mailed Feb. 20, 2014 with English translation.

(Continued)

*Primary Examiner* — Frederick L Lagman
(74) *Attorney, Agent, or Firm* — Frommer Lawrence & Haug LLP; Ronald R. Santucci

(57) ABSTRACT

Facilities for offshore liquefied natural gas (LNG) floating storage with jack-up platform regasification unit, the facilities including: a jack-up unit comprising legs which have bottom part to be fixable to a sea bed and top part to be exposed to a surface of water, and a hull to be movable up and down with respect to the legs; a storage unit moored at the jack-up unit providing a space for storing LNG; a regasification unit as a module which regasifies the LNG supplied from the storage unit, installed on a top portion of the jack-up unit, separable from the jack-up unit; a utility unit comprising a power source and a sea water pump to supply power and sea water to the regasification unit; and a piping unit comprising unloading pipe for connecting the regasification unit and the storage unit and supplying pipe for carrying natural gas gasified by the regasification unit.

7 Claims, 3 Drawing Sheets

(52) U.S. Cl.
CPC ..... *E02B 17/021* (2013.01); *E02B 2017/006* (2013.01); *F17C 2221/033* (2013.01); *F17C 2223/0161* (2013.01); *F17C 2223/033* (2013.01); *F17C 2225/0123* (2013.01); *F17C 2225/035* (2013.01); *F17C 2265/05* (2013.01); *F17C 2270/0113* (2013.01); *F17C 2270/0123* (2013.01)

(56) References Cited

U.S. PATENT DOCUMENTS

| | | | | |
|---|---|---|---|---|
| 4,365,576 | A * | 12/1982 | Cook | 405/200 |
| 4,907,912 | A * | 3/1990 | Smith | 405/210 |
| 5,102,264 | A | 4/1992 | Thomas et al. | |
| 5,129,759 | A * | 7/1992 | Bishop | 405/210 |
| 8,292,546 | B2 * | 10/2012 | Wu | 405/210 |
| 2005/0115248 | A1 | 6/2005 | Koehler et al. | |
| 2009/0208294 | A1 * | 8/2009 | Yao et al. | 405/196 |
| 2011/0013989 | A1 * | 1/2011 | Wu | 405/210 |

FOREIGN PATENT DOCUMENTS

| | | | |
|---|---|---|---|
| CN | 201526043 | U | 3/2009 |
| GB | 2 333 149 | A | 7/1999 |
| JP | 58-032909 | A | 2/1983 |
| JP | 61-261513 | A | 11/1986 |
| JP | 2002-356196 | | 12/2002 |
| JP | 3504771 | B | 12/2003 |
| JP | 2009-191860 | | 8/2009 |
| JP | 2010-265938 | | 11/2010 |
| KR | 10-1991-0008249 | A | 5/1991 |
| KR | 10-2007-0085870 | A | 8/2007 |
| KR | 10-2010-0135354 | A | 12/2010 |
| WO | WO 2010/137827 | A2 | 2/2010 |

OTHER PUBLICATIONS

Non-Final Rejection issued by Japanese Patent Office for corresponding Japanese application 2013-547306 dated Dec. 19, 2014 with English translation.

* cited by examiner

FACILITIES FOR OFFSHORE LIQUEFIED NATURAL GAS FLOATING STORAGE WITH JACK-UP PLATFORM REGASIFICATION UNIT

This application is a 371 of PCT/KR2011/009771 filed on Dec. 19, 2011, published on Jul. 5, 2012 under publication number WO 2012/091336, which claims priority benefits from Korean Patent Application Number 10-2010-0139361 filed Dec. 30, 2010, the disclosure of which is incorporated herein by reference.

TECHNICAL FIELD

The present invention relates to facilities for offshore liquefied natural gas (LNG) floating storage with jack-up platform regasification unit, and more particularly, to offshore facilities that have floating storage and regasification unit installed on jack-up platform. Compared to conventional regasification facility which is installed on LNG carriers or onshore LNG terminal, this concept have been found to reduce installation, operating costs and construction time, and moreover increases stability of regasification performance of LNG.

BACKGROUND ART

The regasification facilities are used for regasification of LNG, i.e., to turn LNG back into natural gas. There facilities can be identified into two different types, onshore and offshore. In onshore facilities, LNG storage and regasification units are installed onshore, whereas offshore facilities include a floating LNG storage unit, usually an LNG carrier or a gravity based structure (GBS), and a regasification unit installed on the floating structure, a shuttle regasification vessel (SRV) or a LNG regasification vessel (RV).

The SRV or the LNG RV is special purposed vessels that can navigate with regasification facilities. The procedure starts by loading LNG from where it is produced and transports to an unloading location where then it is moored by submerged turret loading (STL) in offshore. These vessels have been widely used in the US, etc. for supplying natural gas and have been constructed by several Korean shipbuilding companies.

In light of growing of LNG demand, many attempts have been considered to construct new FSRU, but only several second-handed LNG carriers had been converted to FRSU due to economical reason and time constrains to deliver in Latin America and Asia, etc.

Construction of onshore facilities, however, faces more severe constrains. A large site has to be secured near facilities where LNG carriers are moored, and large scale construction incurs high cost, complex civil appeals of neighboring residents, and immobility of the facility once the construction is over. Thus, in many cases, offshore facilities are considered as a better solution for the fast tract of supplying natural gas.

Nevertheless, when newbuilding or conversion of FRSU is considered, the construction period expands to several years along with high capital costs. Also, when a second-handed LNG carrier conversion is considered, one has to account for the age of the vessel and cargo containment type, since it determines the conversion cost and period. With respect to the cargo containment type, LNG carriers with membrane cargo containment system have to go through a partial reinforcement on its membrane structure to support the regasification facilities on the upper deck. Storage of LNG and operation of regasification facilities are restricted due to the risk of sloshing damage from frequent partial loading of LNG.

Meanwhile, FSRU or SRV is moored to a jetty structure to withstand offshore weather and conditions. LNG is supplied to FSRU from LNC carrier (LNGC) through a loading arm installed on a jetty where both FSRU and LNGC are moored side by side. Once regasified by FSRU or SRV, high pressured natural gas (usually between 40 and 90 atm) is supplied to onshore through high pressure gas arm. During this process, because floating facilities like FSRU or LNG RV are influenced by tidal currents and wind, directional and rotational motions are accompanied. Thus, the loading arm and the high pressure gas arm have a large number of components which can absorb impact from the motions. If the FSRU or the LNG carrier is disconnected from the jetty beyond an operational range, the pipe line will automatically disconnect from the jetty for the safety. Although general LNG carriers are designed to operate under several pressures while loading and unloading of LNG, FSRU and LNG RV are constantly exposed to high pressure natural gas leak which can cause a fire or an explosion.

DISCLOSURE OF INVENTION

Technical Problem

The present invention, facilities for offshore LNG floating storage with jack-up platform regasification unit, is designed for reduction of a construction time and cost, and enhances the stability for operation when compared to a newly constructed or converted FSRU and LNG RV.

Solution to Problem

According to an aspect of the present invention, there is provided a facilities for offshore liquefied natural gas (LNG) floating storage with jack-up platform regasification unit, the facilities comprising: a jack-up unit comprising legs which have bottom part to be fixable to a sea bed and top part to be exposed to a surface of water, and a hull to be movable up and down with respect to the legs; a storage unit moored at the jack-up unit providing a space for storing LNG; a regasification unit as a module which regasifies the LNG supplied from the storage unit, installed on a top portion of the jack-up unit, separable from the jack-up unit; a utility unit comprising a power source and a sea water pump to supply power and sea water to the regasification unit; and a piping unit comprising unloading pipe for connecting the regasification unit and the storage unit and supplying pipe for carrying natural gas gasified by the regasification unit.

The utility unit may be implemented as a module to be separable from the jack-up unit.

The regasification unit may be used an open rack vaporizer (ORV) using sea water for heat exchanger.

The sea water pump and a ballast water pump disposed in the storage unit may be simultaneously used to supply sea water to the regasification unit.

A power facility, a steam generator, and a ballast water pump disposed in the storage unit may be used to supply power, steam, and sea water, respectively, which are necessary for the regasification unit.

The storage unit may be fixed to the jack-up unit and carries the LNG to the regasification unit.

The storage unit may be separable from the jack-up unit and movable to load LNG.

The storage unit may be the LNG carrier or an FSU.

Advantageous Effects of Invention

The present invention of offshore LNG floating storage with jack-up platform regasification unit can provide a solution that can dramatically reduce the possibilities of high pressured natural gas leak into the atmosphere when compared to regasification on a floating structure.

Furthermore, floating capability gives the jack-up unit to relocate and regasify LNG at different region where demand for facility usage occurs.

BEST MODE FOR CARRYING OUT THE INVENTION

The detailed mode for carrying out the present invention will be described hereinafter with reference to exemplary embodiments of the invention.

Figure 1:
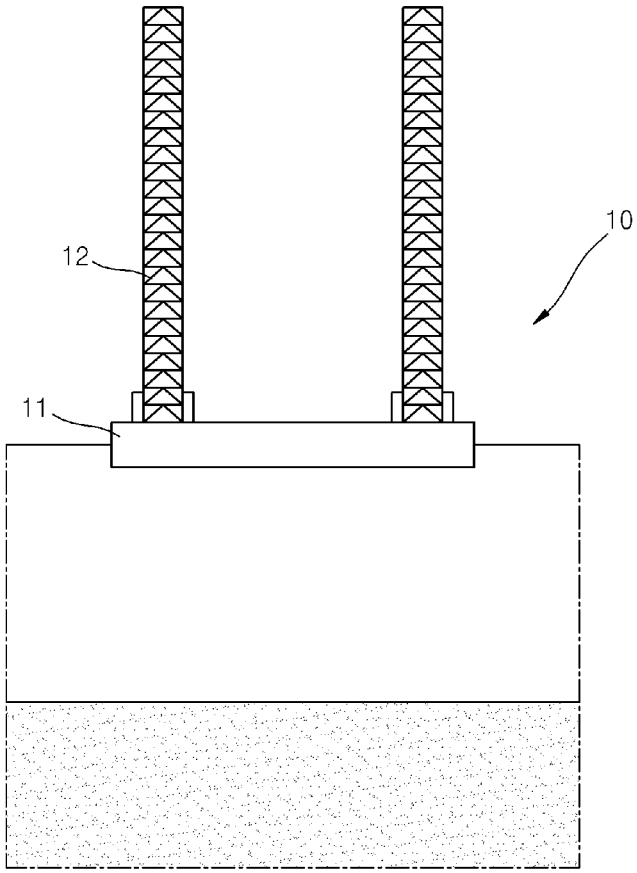
FIGS. 1 through 3 are schematic diagrams of a jack-up unit.
Figure 2:
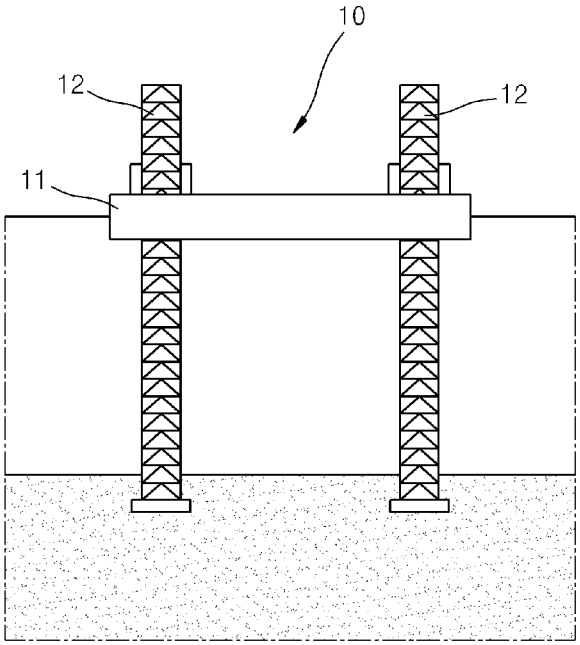
Figure 3:
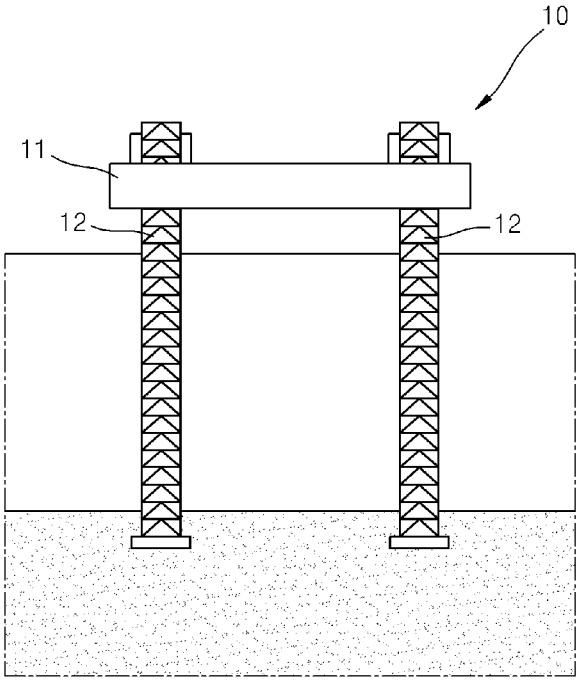
Figure 4:
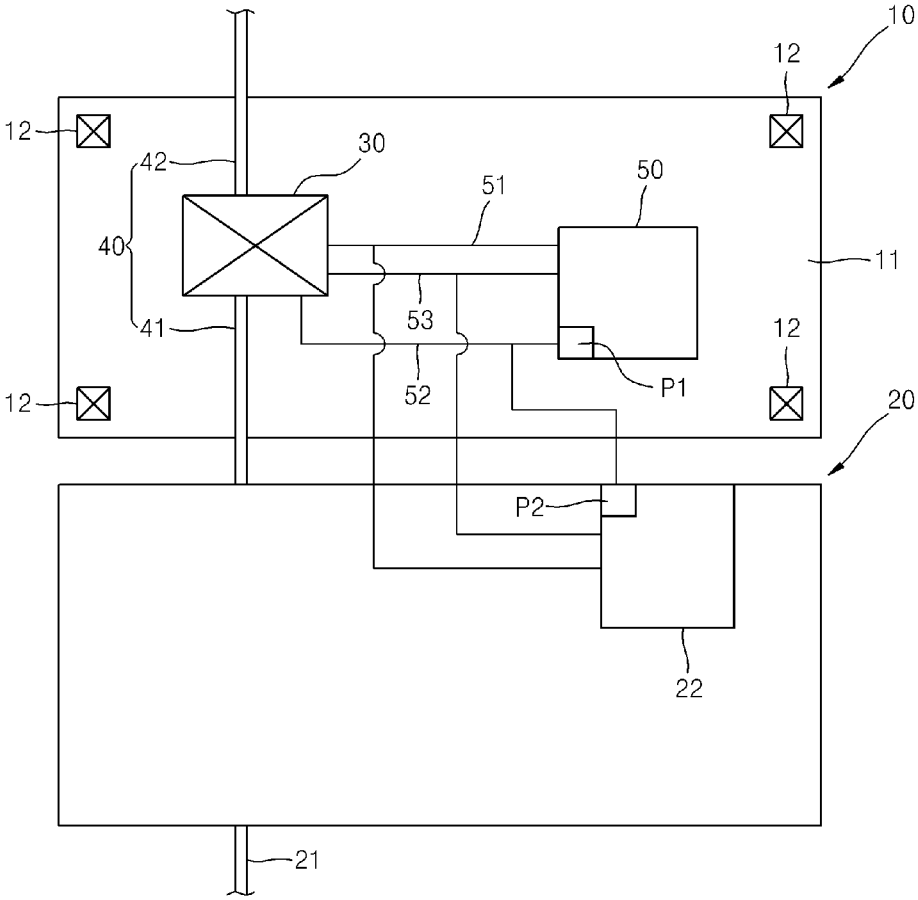
FIG. 4 is a schematic diagram of a liquefied natural gas (LNG) regasification unit according to an embodiment of the present invention.
Figure 5:
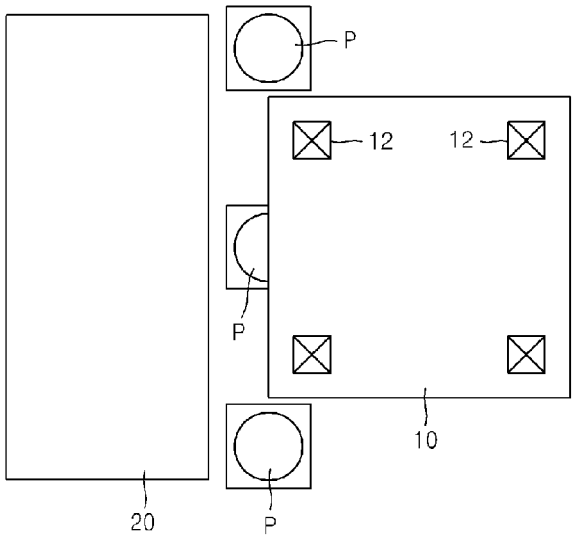
FIGS. 5 and 6 are schematic drawings of steel pipe pile arrangement for reinforcing a jack-up unit.
Figure 6:
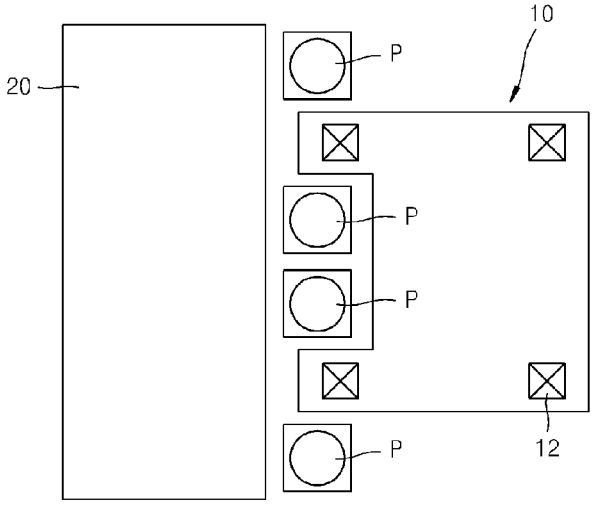
Figure 7:
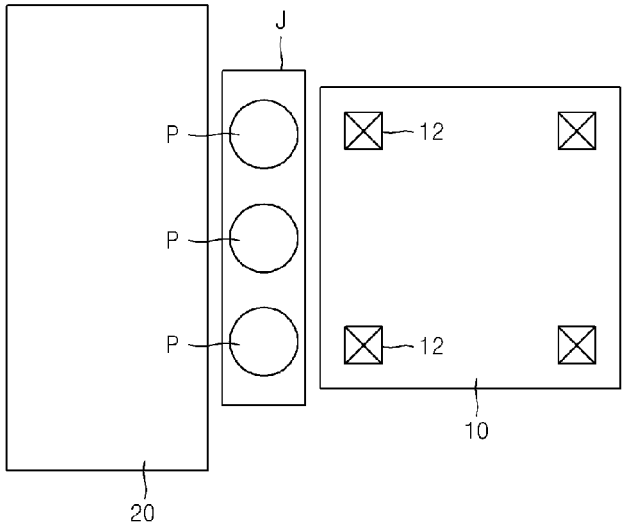
FIG. 7 is a schematic diagram of an LNG regasification unit including a jetty structure.

FIGS. 1, 2 and 3 are schematic diagrams of a jack-up unit 10. FIG. 4 is a schematic diagram of a liquefied natural gas (LNG) regasification unit according to an embodiment of the present invention. FIGS. 5 and 6 are schematic diagrams of an LNG regasification unit including pile structures not to contact a jack-up unit directly according to another embodiment of the present invention; and FIG. 7 is a schematic diagram of an LNG regasification unit including a jetty structure according to another embodiment of the present invention.

The LNG regasification unit, according to the present invention, is used to regasify LNG in offshore and supply the regasified LNG, to gas users onshore. And this invention includes the jack-up unit 10, a storage unit 20, a regasification unit 30, a piping unit 40, and a utility unit 50.

The jack-up unit 10 consists of a hull 11 and legs 12 as shown in FIGS. 1 through 3. The jack-up unit 10 moves by pulling the legs 12 up, minimizing the resistance of the submerged parts as shown in FIG. 1. When the jack-up unit 10 reaches to a desired location, the jack-up unit 10 lowers the legs 12 and fixes the bottom to the seabed as shown in FIG. 2. This moves the hull 11 up to the upper part of the legs 12, allowing the hull 11 to be exposed above the surface of water as shown in FIG. 3. In some cases, the jack-up unit 10 can be used for a drilling facility of oil or natural gas, or a structure for offshore work by placing a crane. According to its purpose, the jack-up unit 10 may be called a jack-up platform, a jack-up rig, etc. The jack-up unit 10 is generally used in a shallow sea (within 120 m water depth).

The hull 11 of the jack-up unit 10 is disposed to move up and down with respect to legs 12. When the hull 11 is exposed to the surface of water as shown in FIG. 3, the hull 11 is maintained at its fixed altitude above sea level and unaffected by waves or tidal current. The hull 11 is not limited to a shape thereof as long as the storage unit 20 can moor at the hull 11. A structure for mooring the storage unit 20, such as a mooring dolphin or a fender, may be installed around the hull 11 of the jack-up unit 10, which is not shown in FIG. 4 for illustrative convenience (all the constituents are simply illustrated in FIG. 4).

The storage unit 20 provides a space for storing LNG once moored at the jack-up unit 10. The storage unit 20 can be converted from a second-handed LNG carrier or an existing LNG floating storage unit (FSU). Meanwhile, the storage unit 20 may be fixedly moored at the jack-up unit 10 and separated from the jack-up unit 10 on occasional demands. Conventional operation involves supplying the LNG to the regasification unit 30 after receiving LNG from another LNG carrier. On an occasional demand, the storage unit 20 may move to a location where LNG is produced or another FSU by itself, then receives LNG therefrom and supply the LNG to the regasification unit 30 again after being moored at the jack-up unit 10. In the latter case, for continuously regasification of LNG, another LNG carrier may supply LNG to the regasification unit 30, at the opposite side of the jack-up unit 10.

Fixed or movable type of the storage unit 20 is determined according to circumstances or economical efficiency. For example, when a converted LNG carrier is used for the storage unit 20, storage type can be decided depending on the situation, as its mobility is already obtained.

Meanwhile, when a second-handed LNG vessel is used for the storage unit 20, the conversion process may require the vessel to operation both LNG loading pipe 21 and LNG unloading pipe 42 simultaneously, as general LNG carrier is designed not to proceed loading and unloading at the same time. Furthermore, if the storage unit 20 is expected to move, an appropriate facility for separating the unloading pipe 42 from the storage unit 20 is required as well.

The storage unit 20 includes a utility facility 22, such as a power facility, a steam generator, a ballast water pump P2, etc. which general LNG carriers and FSU are already equipped, thus no additional facility is needed when the second-handed LNG carrier or the FSU is converted.

The regasification unit 30 is a module for regasifying LNG which is supplied from the storage unit 20. The regasification unit 30 is also separable from the jack-up unit 10. Installment of the regasification unit 30 on the jack-up unit 10, which is fixed on the sea bed, allows LNG to be regasified in offshore without the problems which commonly occurs in operation of conventional FSRU of LNG RV, a danger of leakage of natural gas due to an automatic piping separation in the operation or abrupt disconnection of a high pressure gas arm on the jack-up unit 10 under the various offshore conditions. Since regasification work is performed on the hull 11 of the jack-up unit 10, LNG that is not high pressure gas can be transferred through the pipe between the storage unit 20 and the regasification unit 30. The stability of the hull 11 allows more safe transfer of LNG, regardless of the storage unit 20 movement due to the waves and tidal current.

A heat exchanger of the regasification unit 30 in the present invention is an open rack vaporizer (ORV) that utilizes sea water as a heat source. By contacting the heat exchanger, sea water absorbs the heat and vaporizes LNG into gas. ORV is strongly recommended due to its low investment and operating cost. However, if sea water is not uniformly coated on the vaporizer, the heat exchanger freezes and deteriorates its structure. That is why the ORV cannot be installed on FSRU of LNG RV. For the present invention, fixed structure of the jack-up unit 10 guarantees safe operation of the ORV, which is a relatively inexpensive heat exchange system.

A sea water pump P1 in the utility unit 50 and the ballast water pump P2 of the utility facility 22 in the storage unit 20 are used to supply sea water to the ORV. Although the sea water pump P1 and the ballast water pump P2 are designed to operate simultaneous as depicted in FIG. 41, it is not necessary to use both of them. The sea water pump P1 acts as a main pump and the ballast water pump P2 as an auxiliary pump. Or, only the sea water pump P1 may be operated if the storage unit 20 is disconnected. How to supply the sea water to the ORV are subject to circumstances.

The piping unit 40, connecting the regasification unit 30 and the storage unit 20, includes unloading pipe 41 for supplying LNG from the storage unit 20 to the regasification unit 30 and supply pipe 42 for supplying gasified LNG from the regasification unit 30 to the end users in onshore. If required part of the piping unit 40 may be installed below a sea level.

The utility unit 50 (module) includes a power source, the sea water pump P1, and the steam generator for supplying power, sea water, and steam, respectively, to the regasification unit 30. Similar with the regasification unit 30, it is installed on the jack-up unit 10, but also separable. The utility unit 50 and the regasification unit 30 are connected by a power cable 51, sea water pipe 52, and steam pipe 53. They are respectively connected to the utility facilities in the storage unit 20 to be used simultaneously or complementarily in the present invention. Unlike shown in FIG. 4, only the utility unit 50 may operate independently.

The piping unit 40, the power cable 51, the sea water pipe 52, and the steam pipe 53 are quite simply illustrated in FIG. 4 for illustrative convenience, but the actual design is considerably complicated. Nevertheless, for the purpose of illustration, such simple diagram will be understood by those who have knowledge of this technology.

Now, functions and effects of regasification element will be described below with explanation of LNG regasification process.

LNG stored in the storage unit 20 is supplied to the regasification unit 30 through the unloading pipe 41. Once regasified through the unit 30, regasified LNG is carried to the end users' pipe line onshore through the supplying pipe 42.

The storage unit 20 can be fixed to the jack-up unit 10 to load LNG from an LNG carrier (supplied through the loading pipe 21) or can be moved by itself to receive LNG from a neighboring FSU or a location where LNG is produced. If the storage unit 20 moves to different site, designated replacement should substitute for the previous storage unit 20, in order to supply LNG continuously.

Power, sea water, and steam are supplied to the regasification unit 30 through the utility unit 50.

FIGS. 5 and 6 are describing a jack-up unit 10 with a pile structure P not to contact a jack-up unit directly. Also, FIGS. 5 and 6 are diagrams for explaining the relative arrangement of the jack-up unit 10, the storage unit 20, and the pile structures P. However, plant facilities, such as the regasification unit 30, the piping unit 40, and the utility unit 50, are omitted for illustrative convenience.

The jetty structure J and the pile structures P are shown in FIG. 7. If the jetty structure J is already installed in a place where LNG is to be regasified in offshore, a regasification facility may be designed to be installed on this jetty structure J between the storage unit 20 and the jack-up unit 10. In this case, the jack-up unit 10 needs no additional facility for mooring the storage unit 20 and as the jetty structure J is generally constructed as a fixed structure. LNG regasification can be carried out with more stablity.

While the present invention has been particularly shown and described with reference to exemplary embodiments thereof, it will be understood that various changes in form and details may be possible in the technical range of this invention as defined by the following claims.

The invention claimed is:

1. Facilities for offshore liquefied natural gas (LNG) floating storage with a jack-up platform regasification unit, the facilities comprising:

a jack-up unit comprising legs which have a bottom part to be fixable to a sea bed and a top part to be exposed to a surface of water, and a hull to be movable up and down with respect to the legs;

a storage unit moored at the jack-up unit providing a space for storing LNG;

a regasification unit as a module which regasifies the LNG supplied from the storage unit, installed on a top portion of the jack-up unit, is separable from the jack-up unit;

a utility unit comprising a power source and a sea water pump to supply power and sea water to the regasification unit; and a piping unit comprising unloading pipe for connecting the regasification unit and the storage unit and supplying pipe for carrying natural gas gasified by the regasification unit, wherein the utility unit is implemented as a module to be separable from the jack-up unit.

2. The facilities of claim 1, wherein the regasification unit uses an open rack vaporizer (ORV) using sea water for heat exchanger.

3. The facilities of claim 2, wherein the sea water pump and a ballast water pump disposed in the storage unit are simultaneously used to supply sea water to the regasification unit.

4. The facilities of claim 1, wherein a power facility, a steam generator, and a ballast water pump disposed in the storage unit are used to supply power, steam, and sea water, respectively, which are necessary for the regasification unit.

5. The facilities of claim 1, wherein the storage unit is the LNG carrier or a floating storage unit (FSU).

6. Facilities for offshore liquefied natural gas (LNG) floating storage with a jack-up platform regasification unit, the facilities comprising:

a jack-up unit comprising legs which have a bottom part to be fixable to a sea bed and a top part to be exposed to a surface of water, and a hull to be movable up and down with respect to the legs;

a storage unit moored at the jack-up unit providing a space for storing LNG;

a regasification unit as a module which regasifies the LNG supplied from the storage unit, installed on a top portion of the jack-up unit, is separable from the jack-up unit;

a utility unit comprising a power source and a sea water pump to supply power an sea water to the regasification unit; and a piping unit comprising unloading pipe for connecting the regasification unit and the storage unit and supplying pipe for carrying natural gas gasified by the regasification unit, wherein the storage unit is fixed to the jack-up unit and carries the LNG to the regasification unit.

7. Facilities for offshore liquefied natural gas (LNG) floating storage with a jack-up platform regasification unit, the facilities comprising:

a jack-up unit comprising legs which have a bottom part to be fixable to a sea bed and a top part to be exposed to a surface of water, and a hull to be movable up and down with respect to the legs;

a storage unit moored at the lack-up unit providing a space for storing LNG;

a regasification unit as a module which regasifies the LNG supplied from the storage unit, installed on a top portion of the jack-up unit, is separable from the jack-up unit;

a utility unit comprising a power source and a sea water pump to supply power and sea water to the regasification unit; and a piping unit comprising unloading pipe for connecting the regasification unit and the storage unit and supplying pipe for carrying natural gas gasified by the regasification unit, wherein the storage unit is separable from the jack-up unit and movable to load LNG.

* * * * *